US007127766B1

(12) United States Patent
Carter

(10) Patent No.: US 7,127,766 B1
(45) Date of Patent: Oct. 31, 2006

(54) SKATEBOARD TOOL

(76) Inventor: Christopher L. Carter, 6683 Bunnell Hill Rd., Lebanon, OH (US) 45036

( * ) Notice: Subject to any disclaimer, the term of this patent is extended or adjusted under 35 U.S.C. 154(b) by 219 days.

(21) Appl. No.: 10/843,040

(22) Filed: May 11, 2004

(51) Int. Cl.
*B25F 1/00* (2006.01)
*B25B 13/10* (2006.01)

(52) U.S. Cl. ..... 7/138; 7/165; 81/437

(58) Field of Classification Search ..... 7/138, 7/165; 81/437–439, 490, 177.4, 124.4
See application file for complete search history.

(56) References Cited

U.S. PATENT DOCUMENTS 6,271 A * 12/1830 Blake et al. ..... 81/124.4
D156,354 S * 12/1949 Le Belle ..... D8/28
3,715,165 A * 2/1973 Kuhn ..... 356/369
4,095,917 A * 6/1978 Wesner ..... 408/239 R
4,774,736 A * 10/1988 Brawner et al. ..... 7/138
4,899,409 A * 2/1990 Cox, Jr. ..... 7/167
D308,327 S * 6/1990 Klippel ..... D8/105
6,279,434 B1 8/2001 Brown
6,295,897 B1 * 10/2001 Swank et al. ..... 81/124.4
6,336,385 B1 * 1/2002 Wang ..... 81/177.4

* cited by examiner

*Primary Examiner*—Hadi Shakeri
(74) *Attorney, Agent, or Firm*—R. William Graham

(57) ABSTRACT

A skateboard tool includes a multi-armed body, where four of the arms extend generally in a cross and a fifth arm extends generally perpendicular to a connection between the four arms and is elongated to serve as handle, two of said four arms and the fifth arm include ends formed with sockets therein, a third of the four arms has an end which includes a threading tool and a fourth arm of the four arms has an end which includes a bearing tool.

5 Claims, 2 Drawing Sheets

SKATEBOARD TOOL

BACKGROUND OF THE INVENTION

1. Field of the Invention

The present invention relates to improvements to skateboard tools, particularly to a multifunctional skateboard tool for use in repairing and adjusting skateboards.

2. Description of the Related Art

Skateboarding is a significant sporting activity today and there are specially designed courses for such sport. Due to the extreme wear and use a skateboard undergoes during skateboarding, skateboards frequently require maintenance. Skateboards are used to perform a variety of jumps in addition to rolling and the bearings and support mounts undergo significant stress.

Consequently, tools are used to tighten, adjust or repair the mechanical parts of the board. Such tools include have commonly included socket wrenches of different sizes, a Phillips head screwdriver and/or an Allen key for securing the fasteners which retain the skate on the board or adjusting the axles, etc. as is shown and taught in U.S. Pat. No. 6,279,434, for example.

U.S. Pat. No. 6,279,434 is the current state of the art providing T shaped body having three sockets, one on each end of the T-shaped body. The tool also includes an axially inward open center surface and groove in an upper part of one arm of the T-body to receive an L shaped screw driver with one end having a Phillips head and another end having an Allen wrench head which. One end of the screw driver is intended to be removably disposed within open center surface and the other end seated in the groove.

There is a need to improve tools which are used in the skateboard industry. The present invention improves upon such tools.

SUMMARY OF THE INVENTION

It is an object to improve skateboard tools.

It is an object to provide a skateboard tool having a threading tool.

It is yet another object to provide a skateboard tool having a bearing tool.

It is still another object to provide a skateboard tool having an increased number of tool heads.

It is another object to provide a penta-armed body skateboard tool having a tool on each arm.

Another object is to provide a snap-on T-shaped screwdriver to an exterior surface of a skateboard tool.

Accordingly, the present invention is directed to skateboard tool having a threading tool on one end. The tool further includes a bearing tool on another end. Preferably, the skateboard tool is multipurpose.

The tool is further distinguished from the prior art by its penta-armed body. The penta-armed body includes four of the arms which extend generally in a cross and the fifth arm extends generally perpendicular to a connection between the four arms and is elongated to serve as handle. Two of the four arms as well as the handle include ends formed with sockets and one of the remaining arms has an end which includes the threading tool the other remaining arm has an end which includes the bearing tool.

Additionally, a T-shaped groove is formed in an exterior surface of the body such that part of the groove extends across two of the cross members and along the fifth arm. A T-shaped screw driver is configured to be snap-fit received within the T-shaped groove and includes one end formed with a Phillips head, and the other two ends formed with an Allen type head and/or optionally a flat head.

These and other objects of the present invention will become readily apparent upon further review of the following specification and drawings.

DETAILED DESCRIPTION OF THE PREFERRED EMBODIMENT

Figure 1:
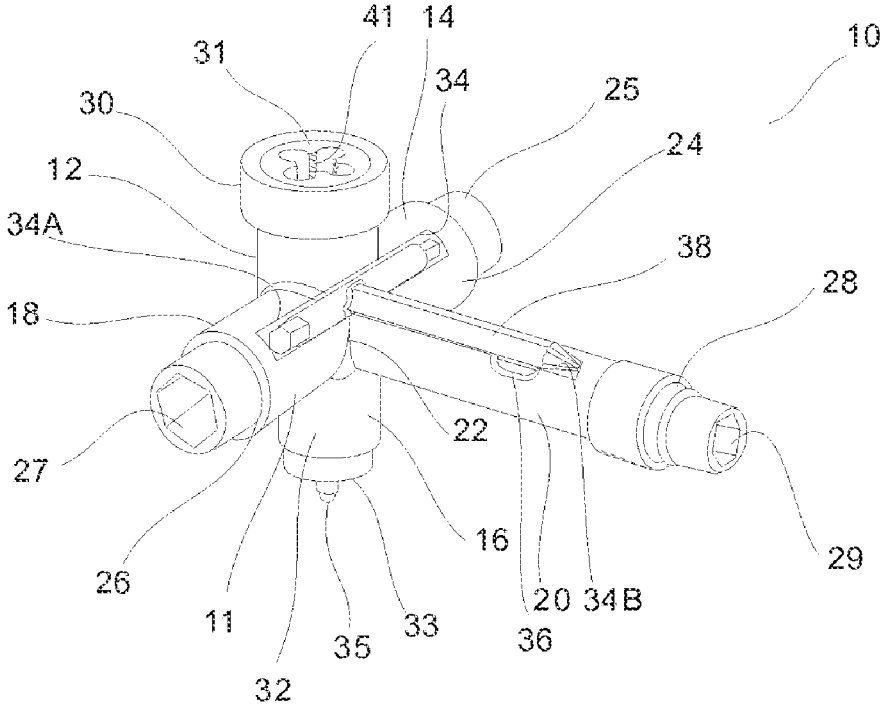
FIG. 1 is a perspective view of a skateboard tool of the present invention.
Figure 2:
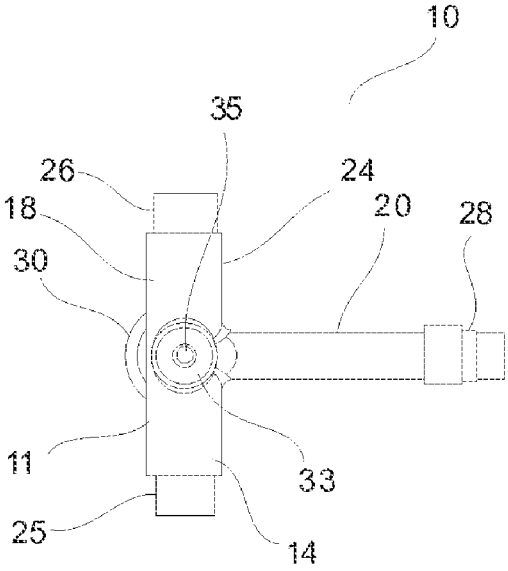
FIG. 2 is a side view of the skateboard tool of FIG. 1 showing a bearing tool.
Figure 3:
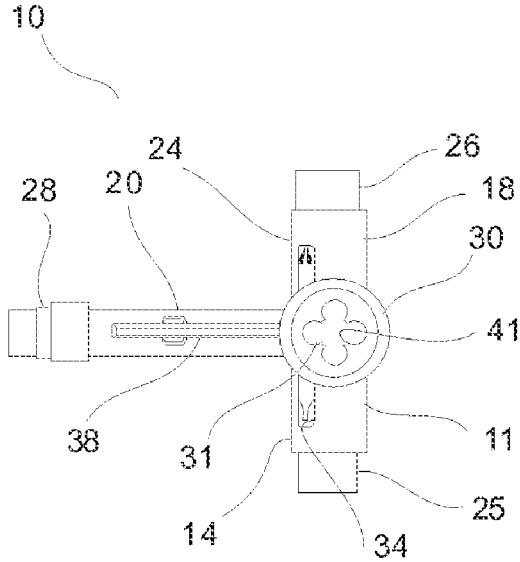
FIG. 3 is another side view of the skateboard tool of FIG. 1 showing a threading tool.
Figure 4:
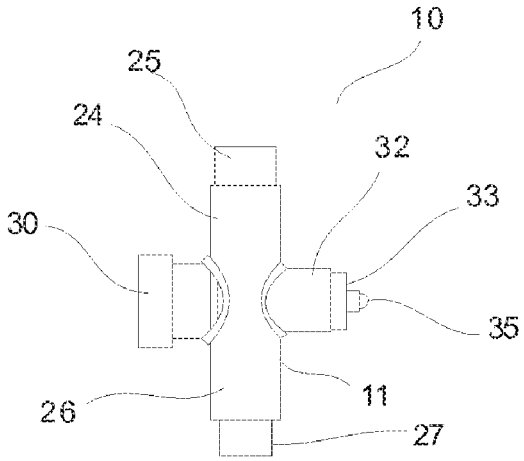
FIG. 4 is an end view of the skateboard tool of FIG. 1.
Figure 5:
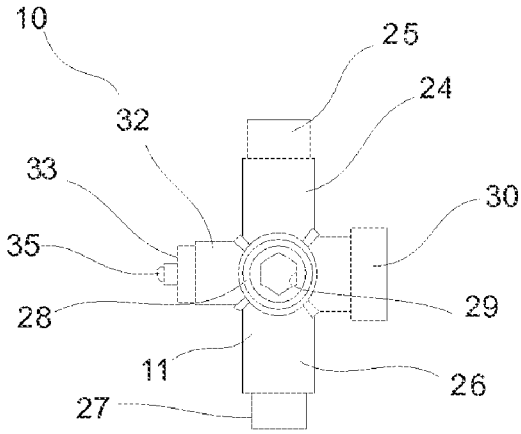
FIG. 5 is another end view of the skateboard tool of FIG. 1.
Figure 6:
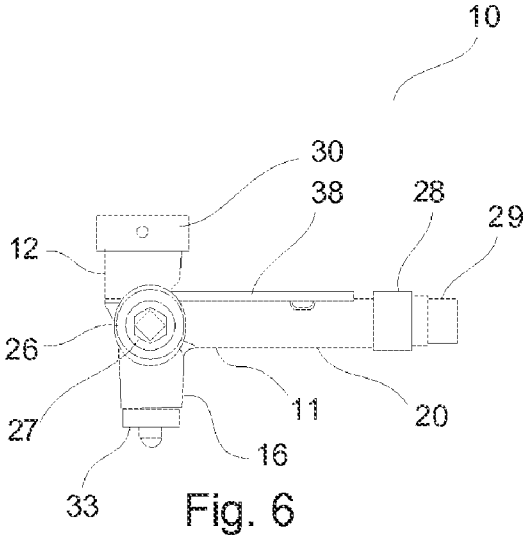
FIG. 6 is yet another side view of the skateboard tool of FIG. 1.
Figure 7:
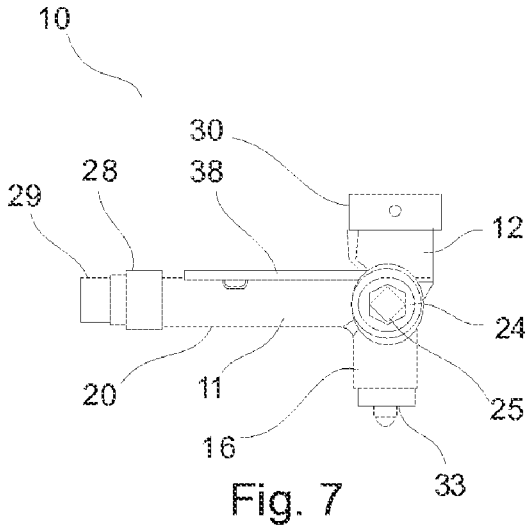
FIG. 7 is still another side view of the skateboard tool of FIG. 1.
Figure 8:
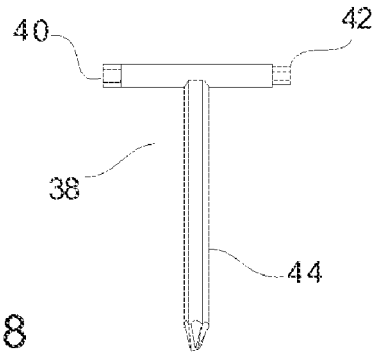
FIG. 8 is a side view of the screwdriver of the skateboard tool according to the present invention.

Referring now to the drawings, the skateboard tool of the present invention is generally designated by the numeral 10. As seen, the skateboard tool 10 is shown as a penta-armed body 11 useful in the repair and adjustment of skateboards as well as the assembly of a skateboard and all its components. For example, the tool 10 is used to attach trucks (turning mechanisms) to a deck and to attach wheels to the trucks.

More particularly, the skateboard tool 10 includes four arms 12, 14, 16, and 18 which extend generally in a cross configuration and the fifth arm 20 which extends generally perpendicular from a central connection 22 between the arms 12, 14, 16, and 18 and is elongated to serve as handle.

Two of the arms 14 and 18 are configured with ends 24 and 26 having hexagonal sockets 25 and 27, a 9/16 inch socket and a ½ inch socket, respectively. The handle 20 includes an end 28 having a socket 29 which can be a ⅜ inch socket. Arm 12 has an end 30 which includes a threading tool 31 and the remaining arm 16 has an end 32 which includes a bearing tool 33 having a nipple 35 thereon. The threading tool 31 is formed with a plurality of cutting surfaces 41 configured to receive an axle of a skateboard which can be used to rethread the axle. This can be done by removing a nut and wheel from the axle, placing the threading tool 31 over the axle and rotatably turning the tool 31 until precluded from further turning, then reversing rotation of the tool 31. The bearing tool 33 can be used to remove bearings of a wheel by inserting the nipple 35 inside the bearing and using the arm 20 for prying the bearing from the wheel. The bearing tool 33 can be used to seat bearing in the wheel by laying the wheel against a flat surface and then pressing bearing tool 33 flush against a bearing with the nipple 35 therein and applying an even force against the bearing to insert the same into a race of the wheel.

A T-shaped groove surface 34 is formed in an exterior surface of the body 11 such that part of the groove surface 34A extends across two of the arms 14 and 18 and another part of the groove surface 34B extends along the arm 20. A pair of recessed surfaces 36 are formed in the exterior surface of arm 20 and intersect part of groove 34B to provide access to a T-shaped screw driver 38.

The T-shaped screwdriver 38 is configured to be snap-fit received within the T-shaped groove surface 34 and includes one end 44 formed with a Phillips head, and the other two ends 40 and 42 formed with Allen type heads, which can be 7/32 inch and 1/8 inch, respectively. Optionally, one end can be a flat head. The T-shaped screwdriver 38 can be easily removed from or stored in the groove surface 34.

While the skateboard tool 10 includes sockets 25, 27 and 29 of particular sizes and orientation, as well as bearing tool 33 and threading tool 31 of a particular orientation with respect to one another, it is contemplated that the orientation and sizes may be varied to carry out the principal advantages of the invention. Likewise, the screwdriver 38 is shown in a T-shape, but it is contemplated that the 34A can be bent for example, to fit within a hypothetical grooved surface formed between arms 12, 18 and 20, for example. The particular orientation of the tool 10 is believed to provide a unique leveraging and gripping surface for one's hand for each of the working ends 24, 26, 28, 30 and 32.

The skateboard tool 10 can be employed to work on a skateboard such that the sockets 25, 27, 29 can be used to either to turn nut or screw heads of their respective size on a skateboard by grasping penta-shaped body 11 in an appropriate manner so as to serve as a wrench. The rethreading tool 31 of the working end 30 can be used to rethread a stripped thread on an axle and bearing tool 33 on end 32 can be used to insert bearings. Screwdriver 38 can be useful in tightening or removing truck parts from the skateboard.

The body 11 can be made of plastic or metal and is of an appropriate size and length to readily facilitate the intended operation of the invention. Preferably, the sockets 25, 27, 29, rethreading tool and bearing tool are made of rigid and hard material such as metal.

The above described embodiment is set forth by way of example and is not for the purpose of limiting the present invention. It will be readily apparent to those skilled in the art that obvious modifications, derivations and variations can be made to the embodiment without departing from the scope of the invention. Accordingly, the claims appended hereto should be read in their full scope including any such modifications, derivations and variations.

What is claimed is:

1. A skateboard tool comprising:

a penta-armed body, where four of said arms extend generally in a cross and a fifth arm extends generally perpendicular to a connection between said four arms and is elongated to serve as handle, two of said four arms and said fifth arm include ends formed with sockets therein, a third of said four arms has an end which includes a threading tool having a plurality of cutting surfaces configured to receive an axle of a skateboard which can be used to rethread the axle and a fourth of said four arms has an end which includes a bearing tool having a nipple formed thereon; and wherein said body includes a T-shaped grooved surface formed in an exterior surface of said body such that part of said grooved surface extends across two of said four arms and part of said grooved surface extends along said fifth arm and further includes a T-shaped screwdriver configured to be snap-fit received within said T-shaped grooved surface.

2. The skateboard tool of claim 1, wherein said T-shaped screwdriver includes a first end formed with a Phillips head a second end formed with an Allen type head and a third end formed with one of an Allen type head and a flat head.

3. The skateboard tool of claim 1, wherein each of said sockets differs in size from each of the other said sockets.

4. The skateboard tool of claim 1, a recessed surface formed in said exterior surface of said fifth arm and intersects part of said grooved surface to provide access to said T-shaped screwdriver.

5. The skateboard tool of claim 1 wherein said first socket is a 9/16 inch socket, said second socket is a 3/8 inch socket, and said third socket is a 1/2 inch socket.

* * * * *